US005599169A

United States Patent [19]

Hauser

[11] Patent Number: 5,599,169

[45] Date of Patent: Feb. 4, 1997

[54] RADIAL IMPELLER FOR A COOLING SYSTEM OF A MOTOR VEHICLE

[75] Inventor: Kurt Hauser, Stuttgart, Germany

[73] Assignee: Behr GmbH & Co., Stuttgart, Germany

[21] Appl. No.: 524,788

[22] Filed: Sep. 7, 1995

[30] Foreign Application Priority Data

Sep. 7, 1994 [DE] Germany ..... 44 31 839.1

[51] Int. Cl.[6] ..... F04D 29/28; F04D 29/02

[52] U.S. Cl. ..... 416/186 R; 416/169 A; 416/241 A

[58] Field of Search ..... 415/183, 186 R, 415/169 A, 241 A

[56] References Cited

U.S. PATENT DOCUMENTS

| | | | |
|---|---|---|---|
| 4,231,706 | 11/1980 | Ueda et al. | 416/186 R |
| 4,795,311 | 1/1989 | Arkhipov et al. | 416/186 R |
| 5,372,477 | 12/1994 | Cole | 415/218.1 |

FOREIGN PATENT DOCUMENTS

| | | | |
|---|---|---|---|
| 906975 | 3/1954 | Germany . | |
| 2530742 | 1/1977 | Germany . | |
| 258839 | 8/1988 | Germany . | |
| 4220227 | 12/1993 | Germany | 416/186 R |
| 57-198396 | 12/1982 | Japan | 416/183 X |
| 580119 | 8/1946 | United Kingdom . | |

OTHER PUBLICATIONS

"Kraftfahrtechnisches Taschenbuch," Bosch, Automotive Handbook, vol. 21, 1991, p. 413.

German Search Report dated Dec. 15, 1994.

*Primary Examiner*—Edward K. Look
*Assistant Examiner*—Michael S. Lee
*Attorney, Agent, or Firm*—Evenson, McKeown, Edwards & Lenahan, P.L.L.C.

[57] ABSTRACT

A fan for a cooling system of a motor vehicle has a radial impeller with multiple vanes which are arranged between an impeller bottom and a cover disk. A stationary intake nozzle extends axially into a cover disk intake, forming an annular gap between the cover disk intake and the intake nozzle. The impeller bottom, the vanes and the cover disk of the radial impeller are made in one piece of a plastic material. A separate air guide ring is arranged on the cover disk at the cover disk intake.

14 Claims, 2 Drawing Sheets

RADIAL IMPELLER FOR A COOLING SYSTEM OF A MOTOR VEHICLE

BACKGROUND AND SUMMARY OF THE INVENTION

The invention relates to a fan for a cooling system of a motor vehicle, having a radial impeller with several vanes disposed between an impeller bottom and a cover disk, wherein a stationary intake nozzle extends axially into a cover disk intake provided with a radius of curvature, and forms an annular gap between the cover disk intake and the intake nozzle.

A fan for a cooling system of a motor vehicle is known from German Patent Publication DE 25 30 742 C3, which has a radial impeller disposed, viewed in the direction of air flow, in back of a heat exchanger of a coolant circuit of the cooling system. The radial impeller is driven via a fluid friction clutch. The fan is used to generate an appropriate air flow through the heat exchanger, in particular when the motor vehicle is stopped or moves slowly and there is insufficient air flow from movement.

Due to the large number of fans to be used in passenger cars, they are as a rule made in one piece by injection molding as described in Bosch, "Kraftfahrtechnisches Taschenbuch" [Automotive Handbook], vol. 21, published by VDI Verlag, Düsseldorf, 1991, page 413.

It is an object of the invention to provide a fan of the above-mentioned type which is suitable for being produced in large numbers and is designed to have advantageous flow properties.

These and other objects have been attained according to preferred embodiments of the invention by providing a fan for a cooling system of a motor vehicle, having a radial impeller with a plurality of vanes disposed between an impeller bottom and a cover disk, and having a stationary intake nozzle extending axially into a cover disk intake, forming an annular gap between the cover disk intake and the intake nozzle, wherein the impeller bottom, the vanes and the cover disk of the radial impeller are made in one piece of a plastic material, and wherein a separate air guide ring is arranged on the cover disk proximate the cover disk intake.

Due to the one-piece production of the radial impeller from a plastic material it is possible to produce a large number of pieces economically. To be able to unmold the impeller from an appropriate plastic injection molding tool, no undercuts which would prevent unmolding should be provided. Furthermore, sucker pins of the injection molding tool, by means of which the vanes of the radial impeller are defined, must have rugged and wear-resistant structural shapes in order to allow a dependable and clean production of the vanes. To prevent the gap between the cover disk intake and the intake nozzle from becoming too large because of the requirements of plastics technology, which would lead to loss of efficiency and increased noise generation, the separate air guide ring has been seated aligned against the cover disk in the area of the cover disk intake.

By using a separate air guide ring for the area of the cover disk intake, is possible to produce the radial impeller in accordance with improved technical flow aspects, while at the same time meeting the requirement of its unmolding as a plastic part, since the area which is critical for the production in accordance with plastics technology, namely the cover disk intake, is formed by separate component. Accordindgly, it is possible to achieve a gap between the cover disk and the intake nozzle which is narrower and is optimized from the viewpoint of flow technology. This results in an improvement of the degree of efficiency and in a reduced noise generation when the fan is operated. In this case the invention relates to all types of radial impellers, whether they have vanes which are backwardly inclined opposite to the direction of rotation, or curved, or radially disposed and/or curved in the direction of rotation.

In accordance with one embodiment of the invention, an inside of the air guide ring is provided with a radius of curvature adapted to the cover disk intake. The radius of curvature of the inside of the air guide ring is preferably either identical to or approximately identical to the radius of curvature of the cover disk intake. By means of this arrangement, an inflow radius is provided in the area of the cover disk intake which is advantageous in accordance with flow technology and which conveys the flow guided back through the gap as well as the main flow into the impeller without separation.

In a further embodiment of the invention, the cover disk as well as the air guide ring) are rounded in the area of their transition on the flow side. This is advantageous if the air guide ring is disposed eccentrically to some degree in respect to the cover disk. Because of this rounding, the separation of the flow passing through the gap is prevented at the connection between the air guide ring and the cover disk on the flow side, by means of which eddy effects which reduce the degree of efficiency of the radial impeller are prevented.

In a preferred embodiment of the invention, the vanes are backwardly inclined or curved in relation to the direction of rotation of the radial impeller. In a further embodiment of the invention a number of vane extensions, which are aligned with the corresponding, associated vanes, are provided on the air guide ring in the extension of each vane leading edge of the radial impeller. In this way, the vane leading edge is elongated, opposite to the flow direction, forward toward the cover disk intake, preventing a detrimental impact of the gap air on the front edges of the backwardly inclined or curved vanes.

In accordance with a further embodiment of the invention a circumferential support collar is provided on the air guide ring, which can be fastened on a corresponding fastening collar of the cover disk with the aid of connecting means. A stable fastening of the air guide ring on the cover disk is provided by this arrangement, which additionally achieves a mutual support effect.

In a further embodiment of the invention the air guide ring is made of a plastic material. In this way, it is possible to design the ring relatively thin so that it has only little weight. For this reason the ring can cause only slight unbalancing when eccentrically placed.

In a further embodiment of the invention the air guide ring is made of a material with a higher density and rigidity than a plastic material. Magnesium is particularly suited for this embodiment. Consequently, the air guide ring has a relatively high sturdiness and assumes a support function by which the impeller sturdiness is increased.

Other objects, advantages and novel features of the present invention will become apparent from the following detailed description of the invention when considered in conjunction with the accompanying drawings.

DETAILED DESCRIPTION OF THE DRAWINGS

Figure 1:
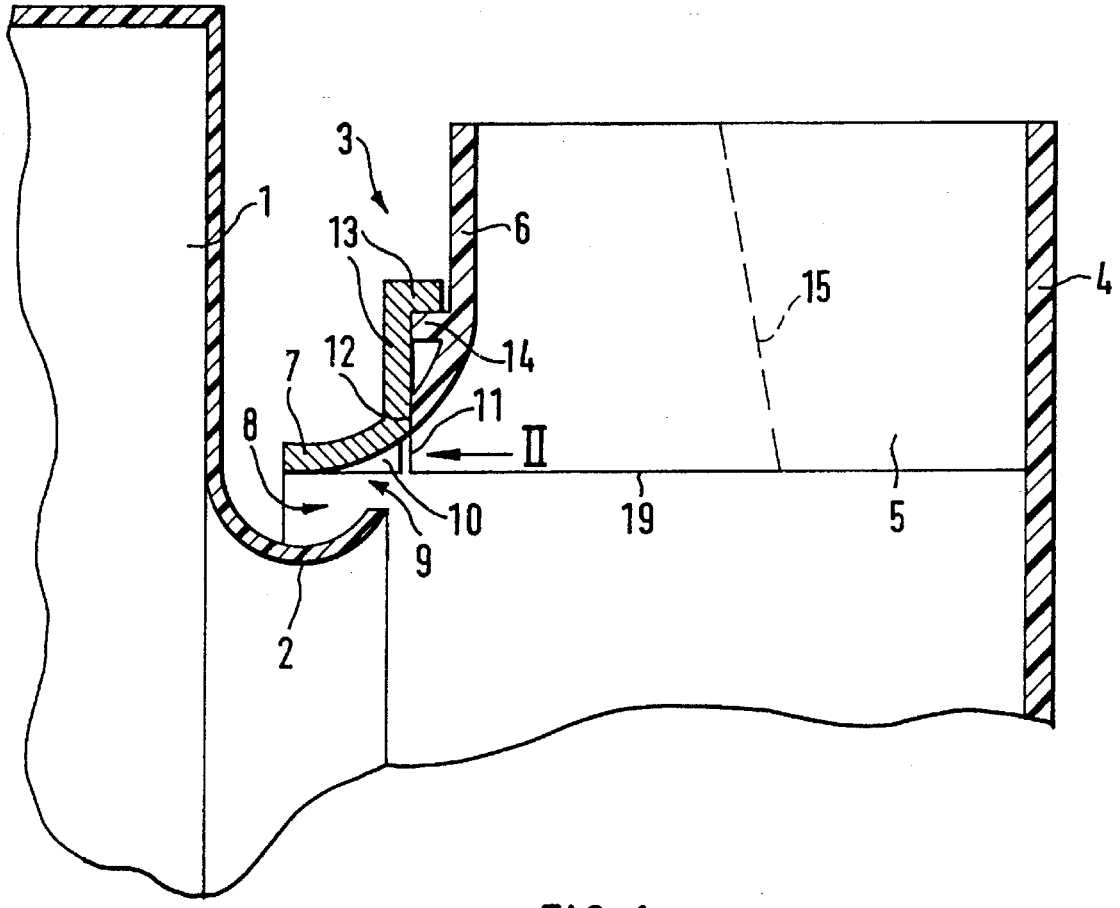
FIG. 1 is a sectional view through a part of a fan constructed in accordance with a preferred embodiment of the invention.

A fan in accordance with FIG. 1 is intended for the cooling system of a motor vehicle and is disposed behind a heat exchanger viewed in the direction of flow of the cooling air. When the motor vehicle does not move or moves only slowly, the fan aspirates air through the heat exchanger in accordance with the flow direction in which the air caused by the movement of the motor vehicle flows through the heat exchanger. A heat exchanger shroud (1) adjoins the heat exchanger and is open in the direction towards a radial impeller (3) by means of a stationary intake nozzle (2) provided with an inflow radius. In a manner not shown, the radial impeller (3) is driven via a fluid friction clutch. The radial impeller (3) has an impeller bottom (4) and a cover disk (6), between which a plurality of vanes (5) are disposed, distributed over the circumference of the radial impeller (3). The impeller bottom (4), the vanes (5) and the cover disk (6) have been made in one piece from a plastic material in an appropriate injection molding device. The vanes (5) are backwardly inclined opposite to a direction of rotation of the radial impeller (3).

A cover disk intake (9) of the radial impeller (3) is formed by a separate air guide ring (7), which adjoins the cover disk (6) on the entry side of the air flow. The air guide ring (7) has a circumferential support collar (13) which is rigidly fastened on the outside on a fastening collar (14) of the cover disk (6) which projects axially away from the cover disk (6). The support collar (13) radially projects outward from the portion of the air guide ring (7) which is aligned with the cover disk (6) and is axially supported in the area of a transition (12) on a front edge of the cover disk (6) as well as on the front side of the fastening collar (14). In the area of its support collar (13), the air guide ring (7) is rigidly connected with the cover disk (6) and with the fastening collar (14) of the cover disk (6). The air guide ring (7) is perfectly joined with the cover disk (6) by welding or bonding. Other connecting means for the rigid, perfect connection of the air guide ring with the cover disk are provided in exemplary embodiments of the invention not represented here.

The radius of curvature of the air guide ring (7) in the area of the cover disk intake (9) corresponds to the radius of curvature of the cover disk (6), so that the inner wall of the air guide ring (7) makes a smooth transition into the inner wall of the cover disk (6). The intake nozzle (2) projects in a known manner into the cover disk intake (9) of the radial impeller (3), creating an annular gap (8) between the air guide ring (7) and the intake nozzle (2), through which a portion of the airflow is returned. Because of the provision of the separate air guide ring (7), the vane leading edge (19) of each vane (5) terminates at the front edge of the cover disk (6) in the area of the transition (12) at a small axial distance from the intake nozzle (2). Each vane (5) of the radial impeller (3) is manufactured with the aid of two sucker pins of the injection molding tool, which follow each other in the injection molding tool along a separation line (15) (shown in dashed lines). The two sucker pins are pulled out one after the other. For reasons of tool technology, a front edge (11) of each vane (5) is drawn radially inward starting at the cover disk (6). If the cover disk (6) were drawn forward in one piece as far as the cover disk intake (9), the front edge (11) would also be further displaced axially in the direction toward the intake and would therefore be located in the area of the gap (8), i.e. radially above the intake nozzle (2). In order to then still make possible the unmolding of the radial impeller (3), the gap (8) would have to be considerably enlarged in comparison with the embodiment in FIG. 1 in accordance with the invention.

Figure 2:
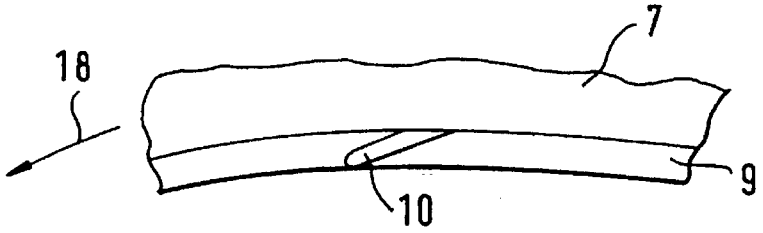
FIG. 2 is a partial view in the direction of the arrow II in FIG. 1 of an air guide ring placed on a cover disk of the radial impeller of the fan of FIG. 1.

To avoid an adverse impact of the air flowing through the gap (8) on the front edge (11) of each vane (5), a number of vane extensions (10) corresponding to the number of vanes (5) are provided on the air guide ring (7), which elongate the vane leading edge (19) toward the front and are aligned with the respectively associated vane (5) (FIG. 2).

Figure 3:
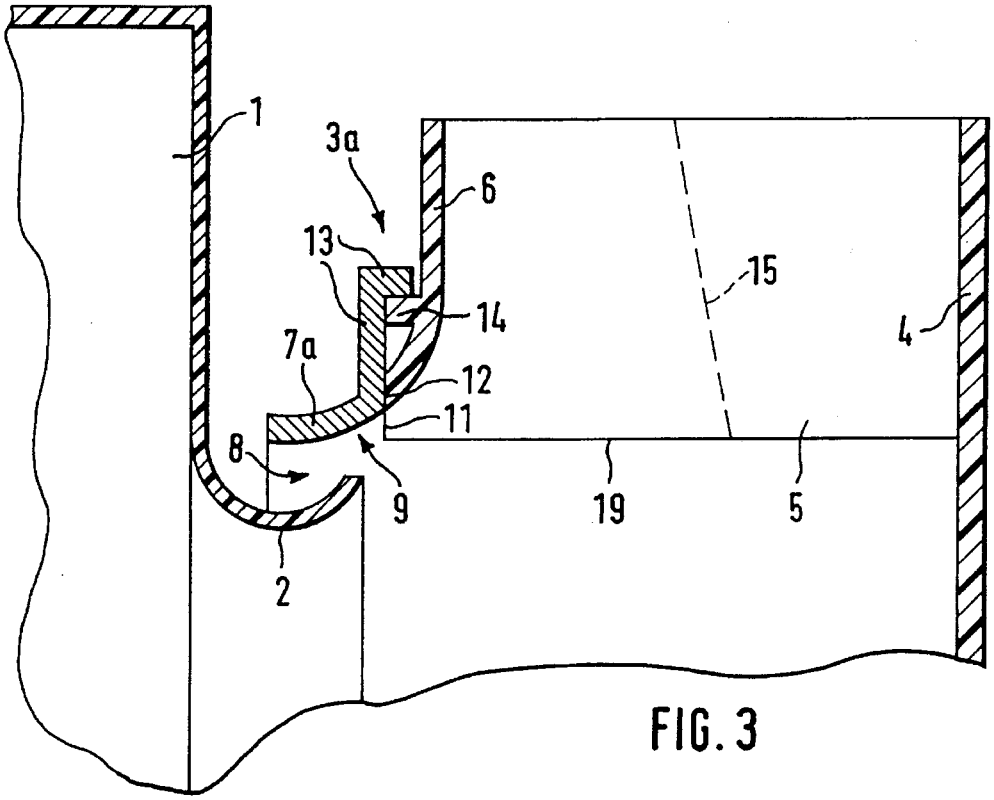
FIG. 3 shows a further embodiment of a radial impeller for a fan similar to that of FIG. 1.

The radial impeller (3*a*) in accordance with FIG. 3 is almost identical with the radial impeller (3) of FIG. 1. However, in contrast with the air guide ring (7) in accordance with FIGS. 1 and 2, the air guide ring (7*a*) of the radial impeller (3*a*) is not provided with vane extensions (10) for elongating the vane leading edge (19) toward the front. Instead, the cover disk intake (9) of the air guide ring (7*a*) has a smooth inner wall.

The air guide ring (7) as well as the air guide ring (7*a*) of the represented preferred embodiments are made of magnesium. As a result, the air guide rings (7 and 7*a*) have a relatively great sturdiness and contribute to increased impeller sturdiness by their rigid connection with the cover disk (6). In this way, the air guide ring (7) as well as the air guide ring (7*a*) take on a support function in regard to the respective radial impeller (3 and 3*a*). In other contemplated embodiments of the invention which are not represented, the corresponding air guide rings are made of a plastic material, resulting in a relatively low weight and therefore only causing a small imbalance of the respective impeller even when eccentrically disposed.

Figure 4:
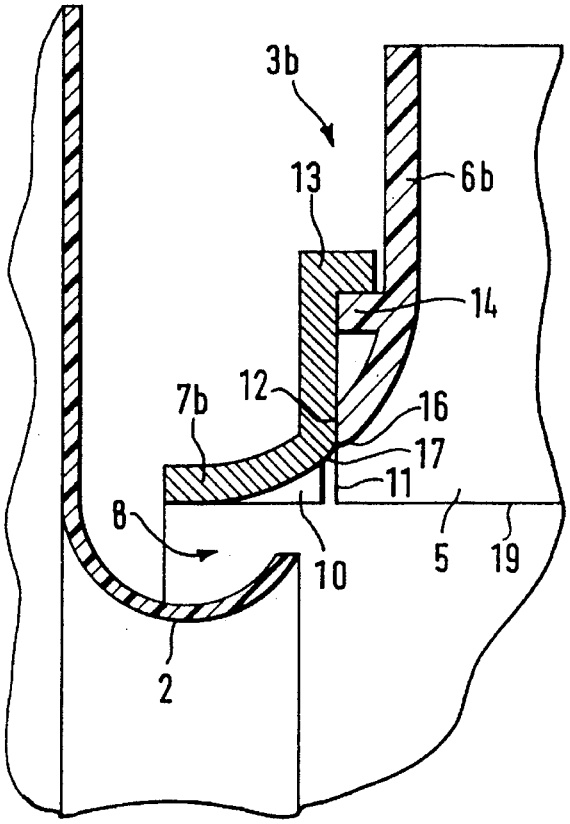
FIG. 4 is an enlarged representation of a section of a fan similar to that of FIGS. 1 and 3 in the area of a gap provided between a cover disk intake and an intake nozzle.

The radial impeller (3*b*) of FIG. 4 essentially corresponds to the radial impeller (3) of FIG. (1). However, in this embodiment the transition (12) between the separate air guide ring (7*b*) and the cover disk (6*b*) is rounded off (16, 17) on the flow side. Therefore the edge of the air guide ring (7*b*) adjoining the front edge of the cover disk (6*b*) at an obtuse angle has a round shape (16), and the front edge of the cover disk (6*b*) has a round shape (17) correspondingly curved in the direction of the air guide ring (7*b*). The two rounded shapes (16, 17) assure that there will be no separation-of the flow from the wall in the area of the radii of curvature of the cover disk and the cover disk intake, even if the air guide ring (7*b*) is disposed slightly eccentrically on the cover disk (6*b*).

Further contemplated embodiments of the invention, which are not shown, have further radial impellers whose cover disk intake is formed by a separate air guide ring designed in accordance with the principles of flow technology. These radial impellers either have radially disposed vanes, or radially disposed vanes curved in the direction of rotation or vanes curved opposite the direction of rotation. These radial impellers are provided with additional shaping of the vanes or of the impeller bottom, depending on the-requirements of flow technology.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A radial impeller for a cooling system of a motor vehicle, comprising:

a plurality of vanes disposed between an impeller bottom and a cover disk, and a cover disk intake which is configured to receive a stationary intake nozzle extending axially into the cover disk intake, an annular gap being formed between the cover disk intake and the intake nozzle, wherein the impeller bottom, the vanes and the cover disk of the radial impeller are made in one piece of a plastic material, and wherein a separate air guide ring is undetachably connected with the cover disk to form the cover disk intake.

2. A radial impeller according to claim 1, wherein an inside portion of the air guide ring is constructed with a radius of curvature adapted to a radius of the cover disk intake.

3. A radial impeller according to claim 1, wherein the air guide ring is rigidly connected with the cover disk.

4. A radial impeller according to claim 1, wherein the air guide ring and the cover disk are each provided with rounded surface portions in an area where the air guide ring adjoins the cover disk.

5. A radial impeller according to claim 4, wherein a circumferential support collar is arranged on the air guide ring and is fastened to a corresponding fastening collar of the cover disk.

6. A radial impeller according to claim 1, wherein the vanes are backwardly inclined with respect to a direction of rotation of the radial impeller.

7. A radial impeller according to claim 6, wherein vane extensions which correspond to respective vanes are provided on the air guide ring, the vane extensions being aligned with the respective vanes in an area of an extension of a leading edge of the respective vanes.

8. A radial impeller according to claim 7, wherein a circumferential support collar is arranged on the air guide ring and is fastened to a corresponding fastening collar of the cover disk.

9. A radial impeller according to claim 1, wherein a circumferential support collar is arranged on the air guide ring and is fastened to a corresponding fastening collar of the cover disk.

10. A radial impeller according to claim 1, wherein the air guide ring is made of a plastic material.

11. A radial impeller according to claim 1, wherein the air guide ring is made of a material of higher density than the plastic material.

12. A radial impeller fan according to claim 11, wherein the material is magnesium.

13. A radial impeller according to claim 1, wherein the vanes are backwardly curved with respect to a direction of rotation of the radial impeller.

14. A radial impeller according to claim 13, wherein vane extensions which correspond to respective vanes are provided on the air guide ring, the vane extensions being aligned with the respective vanes in an area of an extension of a leading edge of the respective vanes.

* * * * *